US009541879B2

(12) United States Patent
Sato

(10) Patent No.: US 9,541,879 B2
(45) Date of Patent: Jan. 10, 2017

(54) MEDIUM CARRYING DEVICE AND IMAGE FORMING APPARATUS

(71) Applicant: Oki Data Corporation, Tokyo (JP)

(72) Inventor: Haruo Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 38 days.

(21) Appl. No.: 14/190,521

(22) Filed: Feb. 26, 2014

(65) Prior Publication Data

US 2014/0241776 A1 Aug. 28, 2014

(30) Foreign Application Priority Data

Feb. 27, 2013 (JP) ..... 2013-036675

(51) Int. Cl.

| | |
|---|---|
| ***B65H 5/36*** | (2006.01) |
| ***B65H 3/66*** | (2006.01) |
| ***G03G 15/00*** | (2006.01) |
| ***G03G 21/16*** | (2006.01) |
| ***B65H 85/00*** | (2006.01) |
| ***B65H 5/38*** | (2006.01) |

(52) U.S. Cl.

CPC ..... *G03G 15/6529* (2013.01); *B65H 5/38* (2013.01); *B65H 85/00* (2013.01); *G03G 21/1695* (2013.01); *B65H 2404/6111* (2013.01); *B65H 2404/65* (2013.01); *B65H 2601/11* (2013.01)

(58) Field of Classification Search

CPC ..... G03G 21/1638; G03G 2221/1675; G03G 21/1695; G03G 2215/00345; G03G 2215/00434; G03G 2215/0035; G03G 2215/00405; G03G 2215/00675; B65H 2601/11; B65H 2404/65; B65H 5/36; B65H 3/66

See application file for complete search history.

(56) References Cited

U.S. PATENT DOCUMENTS

| | | | | |
|---|---|---|---|---|
| 2007/0057438 | A1* | 3/2007 | Kurokawa et al. | 271/164 |
| 2009/0166966 | A1* | 7/2009 | Nishikata | B65H 5/062 271/272 |
| 2012/0161385 | A1* | 6/2012 | Haruyama | 271/121 |

FOREIGN PATENT DOCUMENTS

| | | | | |
|---|---|---|---|---|
| JP | 2000143015 A | * | 5/2000 | B65H 5/06 |
| JP | 2004-196461 A | | 7/2004 | |
| JP | 2010285253 A | | 12/2010 | |

* cited by examiner

*Primary Examiner* — Daniel J Colilla
*Assistant Examiner* — Ruben Parco, Jr.
(74) *Attorney, Agent, or Firm* — Muncy, Geissler, Olds & Lowe, P.C.

(57) ABSTRACT

A medium carrying device includes a first carrying part and a second carrying part that are configured to carry a medium, making a nip part therebetween. The guide member includes a medium regulation part having a surface to regulate the medium, an arm part that is at a side of the surface and extend in a direction away from the surface, and a rotation supporting point that is on a distal end of the arm part, and the guide member is formed rotatable around the rotation supporting point between the guide position and a retreat position, the retreat position being more distant to the nip part than the guide position.

15 Claims, 13 Drawing Sheets

MEDIUM CARRYING DEVICE AND IMAGE FORMING APPARATUS

CROSS REFERENCE TO RELATED APPLICATION

The present application is related to, claims priority from and incorporates by reference Japanese Patent Application No. 2013-036675, filed on Feb. 27, 2013.

TECHNICAL FIELD

The present invention relates to an image forming apparatus and in particular relates to a medium carrying device of the image forming apparatus.

BACKGROUND

In a conventional image forming apparatus, a sheet carried from a sheet feeding tray is sent into an image forming part by a carrying roller, and printing onto the medium is performed (for example, see Japanese Patent Laid-Open Publication No. 2004-196461 (page 5, FIG. 1)).

When a medium is jammed in a carrying route, it is difficult to remove the jammed medium.

SUMMARY

A medium carrying device includes a first carrying part and a second carrying part that are configured to carry a medium, making a nip part therebetween and a guide member that is positioned at a guide position to regulate the medium toward the nip part. The guide member includes a medium regulation part that has a surface to regulate the medium that is carried on the surface toward the nip part, an arm part that is arranged at a side of the surface and extend in a direction away from the surface, and a rotation supporting point that is formed on a distal end of the arm part that is distant from the medium regulation part, and the guide member is formed rotatable around the rotation supporting point between the guide position and a retreat position, the retreat position being more distant to the nip part than the guide position.

According to the present invention, a guide member can be moved between a guide position that is close to a nip part of a first roller and a second roller and a retreat position that is spaced apart from the contact part. Therefore, carrying performance of the medium can be improved and a jammed medium can also be easily removed.

BRIEF DESCRIPTION OF DRAWINGS

FIG. 5A illustrates a front view; FIG. 5B illustrates a left side view; and FIG. 5C illustrates a partial cross-sectional view illustrating a portion of an A-A cross section in the left side view of FIG. 5B.

FIG. 12A illustrates a front view; FIG. 12B illustrates a left side view; and FIG. 12C illustrates a partial cross-sectional view illustrating a portion of a B-B cross section in the left side view of FIG. 12B.

DETAILED DESCRIPTION OF EMBODIMENTS

First Embodiment

Figure 1:
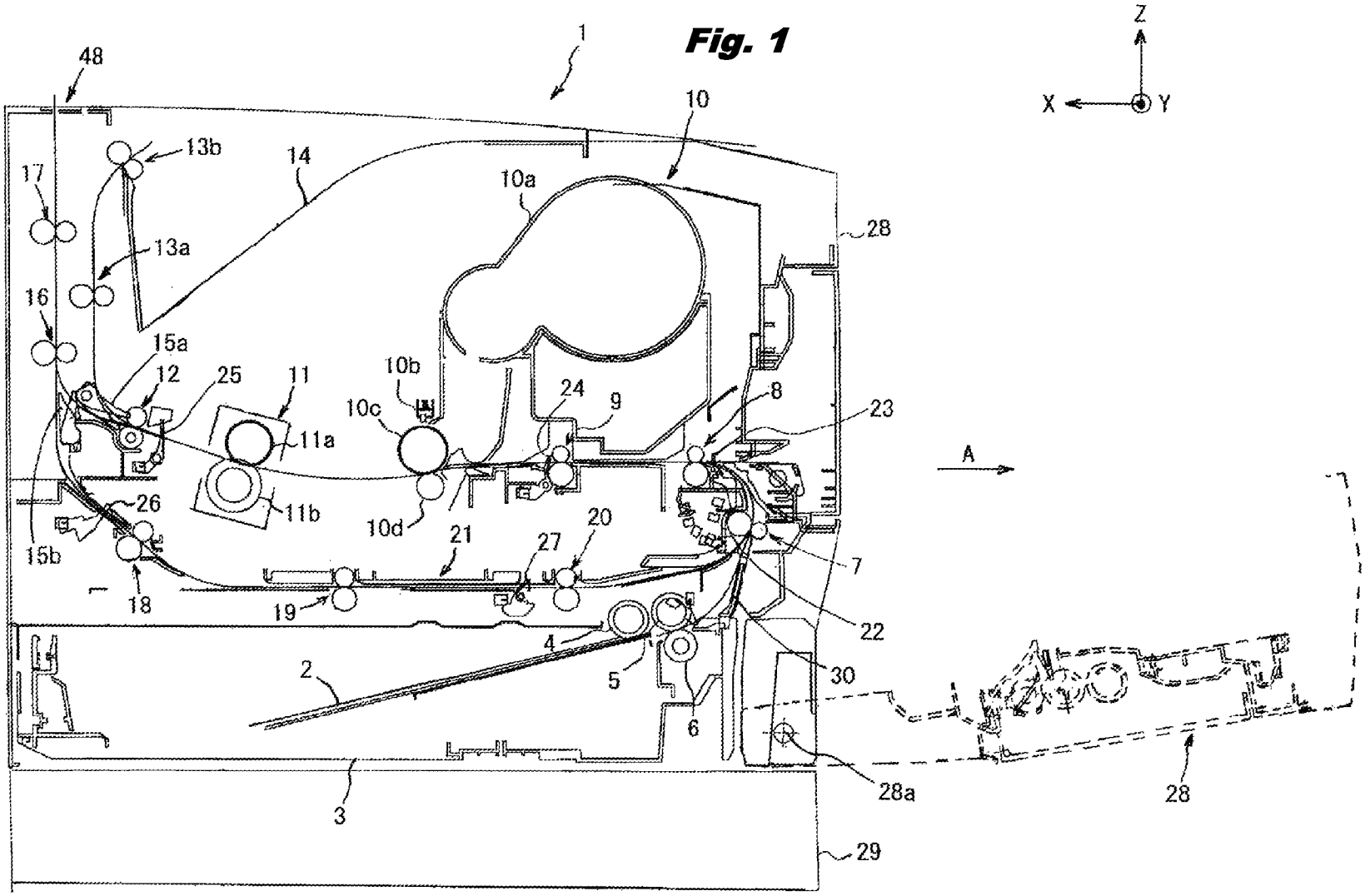
FIG. 1 illustrates a schematic configuration diagram for describing a main part configuration of an image forming apparatus of a first embodiment that adopts a medium carrying device according to the present invention.

FIG. 1 illustrates a schematic configuration diagram for describing a main part configuration of an image forming apparatus of a first embodiment that adopts a medium carrying device according to the present invention.

As illustrated in FIG. 1, in a printer 1 as an image forming apparatus, a sheet feeding cassette 3 housing a recording sheet 2 as a medium that is stacked is detachably attached to a bottom part of the printer 1. The sheet feeding cassette 3 can be pulled out in a direction of an arrow A that is a front side direction of the printer 1. On an upper portion on a sheet take-out side of the sheet feeding cassette 3, a pickup roller 4 with which the recording sheet 2 that is stacked is in pressure-contact is rotatably arranged. In a vicinity of the pickup roller 4, a sheet feeding roller 5 and a retard roller 6 are arranged in a manner opposing each other for bringing out one by one the recording sheet 2 upward (to a downstream side in a sheet carrying direction), the recording sheet 2 being brought out from the sheet feeding cassette 3 by the pickup roller 4.

The recording sheet 2 that is brought out one by one by the sheet feeding roller 5 and the retard roller 6 is sent by a first registration roller pair 7, a second registration roller pair 8 and a carrying roller pair 9 that are sequentially arranged along a carrying route to an image forming part 10 that is arranged on a downstream side of these roller pairs.

The image forming part 10 is configured by a toner cartridge 10*a*, a recording head 10*b*, a photoreceptive drum 10*c*, a transfer roller 10*d* and the like, and transfers a toner image corresponding to recording data onto the recording sheet 2 that is carried. A fixing device 11 is arranged on a downstream side of the image forming part 10 in the carrying direction. The fixing device 11 is a device that fixes the toner image (that has been transferred to the recording sheet 2) onto the recording sheet 2 by heating and melting, and is configured by a fixing roller 11*a* and a pressing roller 11*b* that is in pressure-contact with the fixing roller 11*a*.

On a downstream side of the fixing device 11 in the carrying direction, carrying roller pairs 12 and 13*a*, 13*b* are sequentially provided along the carrying route. The recording sheet 2, onto which the toner image is fixed and which is discharged from the fixing device 11, is discharged to an ejection part 14 that is arranged on an upper part of the printer 1. In the ejection part 14, the printed recording sheet 2 is sequentially stacked. In order to detect a carrying position of the recording sheet 2 that is carried, a sensor 22 immediately before the first registration roller pair 7, a sensor 23 immediately before the second registration roller pair 8, a sensor 24 between the carrying roller pair 9 and the transfer roller 10*d*, and a sensor 25 between the fixing device 11 and the carrying roller pair 12 are respectively arranged.

The printer 1 is provided with a configuration capable of performing duplex printing of the recording sheet 2. Next, a case of performing duplex printing is described.

Therefore, on a downstream side of the carrying roller pair 12, a blade 15*a* that determines a path of the recording sheet 2, reversing roller pairs 16, 17 that switchback and carry the recording sheet 2 for carrying in and out the recording sheet 2 with respect to a retreat part 48, a blade 15*b* and a carrying roller 18 that guide the recording sheet 2 (that is reversed and carried) to a duplex unit 21 (to be described later) as a unit that can be pulled out, carrying roller pairs 19, 20 that carry the recording sheet 2 (that has been guided to a reversed carrying route in the duplex unit 21) again to the first registration roller pair 7, and sensors 26, 27 for performing sheet position detection are arranged.

Therefore, when performing duplex printing, the recording sheet 2, for which printing on a front side has finished, is temporarily housed in the retreat part 48 by the blade 15*a* and the reversing roller pair 16. Thereafter, a rear end part of the recording sheet 2 (that is housed) is sent as a front end part to the duplex unit 21 by the reversing roller pairs 16, 17 that perform the reversing, the blade 15*b* and the carrying roller 18. The recording sheet 2 that is sent into the duplex unit 21 is carried again to the first registration roller pair 7 by the carrying roller pairs 19, 20. A side (back side) on which printing has not been performed becomes an upper side (printing side) and printing on the back side is performed in the same way as when printing on the front side is performed.

A front cover 28 as a cover member is configured to be able to rotate about a rotation shaft 28*a* to be opened to an open position as illustrated in FIG. 1, in which a shape and a main part are illustrated using a dotted line, in order to pull out the duplex unit 21 in the direction of the arrow A that is the front side of the printer 1. At a lower portion of the printer 1, an optional sheet feeding cassette 29 is arranged that allows additional supply of the recording sheet 2.

X, Y and Z axes in FIG. 1 are set as follows. The X axis is along the carrying direction when the recording sheet 2 passes through the carrying rollers 8, 9. The Y axis is along a direction of a rotation axis of the photoreceptive drum 10*c*. The Z axis is along a direction orthogonal to the X and Y axes. Further, when the X, Y and Z axes are illustrated in other drawings (to be described later), the directions of these axes indicate common directions. That is, the X, Y and Z axes in each of the drawings indicate arrangement directions of an illustrated portion in the each of the drawings when the printer 1 illustrated in FIG. 1 is configured. Here, it is assumed that the printer 1 is arranged in such a manner that the Z axis is along a substantially vertical direction.

Next, the duplex unit 21 that is held slidable in the direction of the arrow A in the state in which the front cover 28 of the printer 1 is opened to the open position illustrated by the dotted line in FIG. 1 and a holding mechanism of the duplex unit 21 are described.

Figure 2:
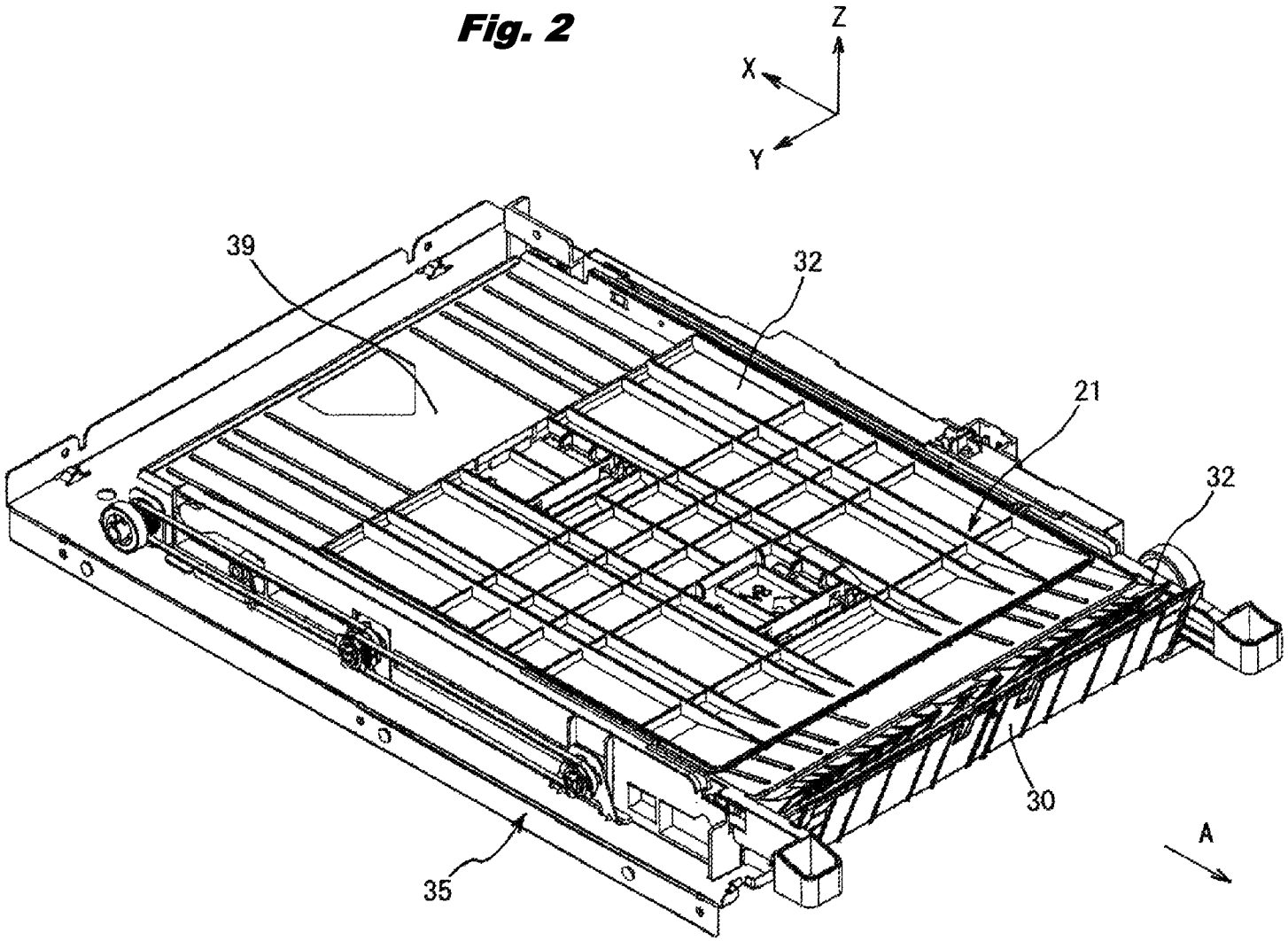
FIG. 2 illustrates an external perspective view of a duplex unit and a base unit that is fixed at a predetermined position inside a printer and slidably holds the duplex unit in the first embodiment.
Figure 3:
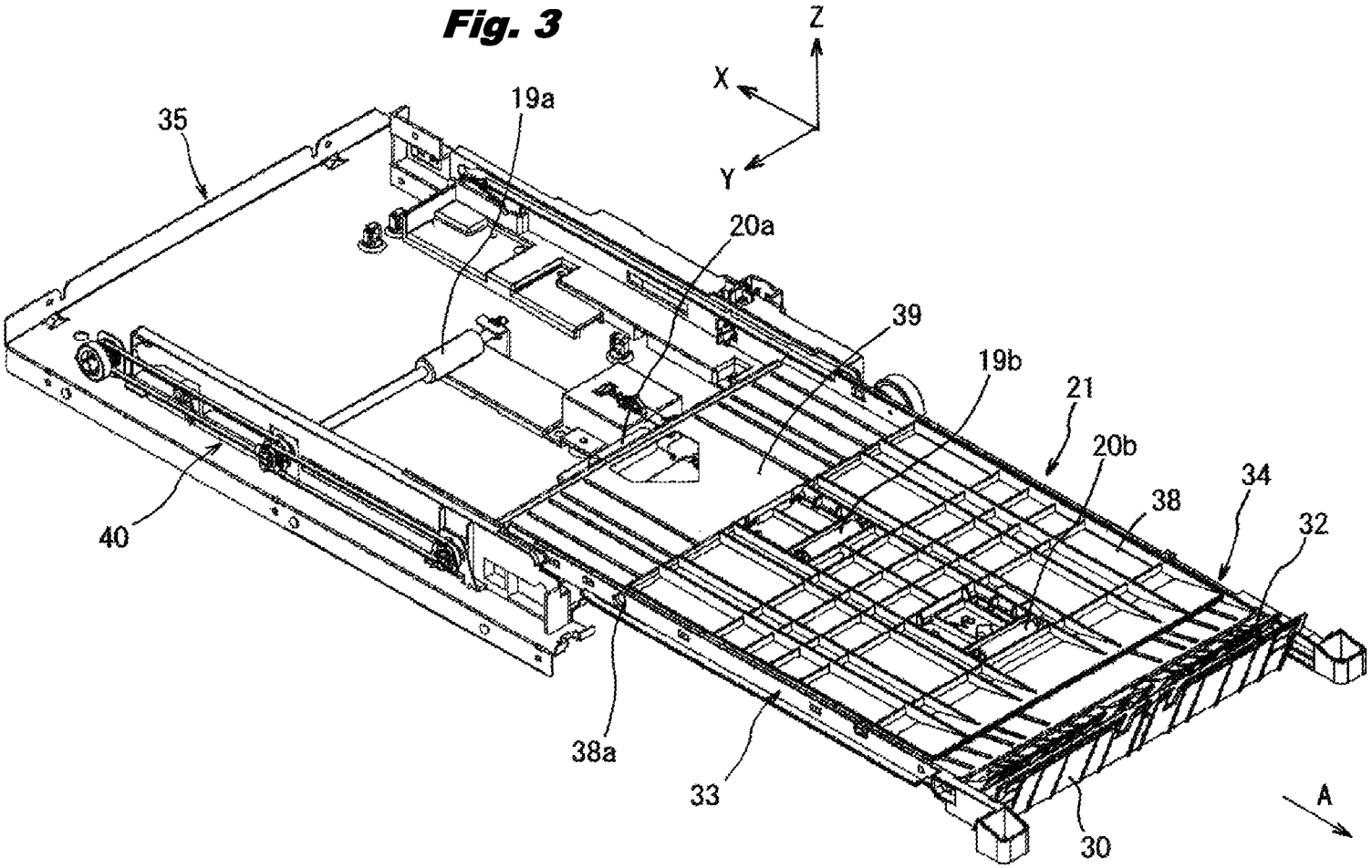
FIG. 3 illustrates an external perspective view illustrating a state when the duplex unit is pulled out from the base unit in a direction of an arrow A in the first embodiment.
Figure 4:
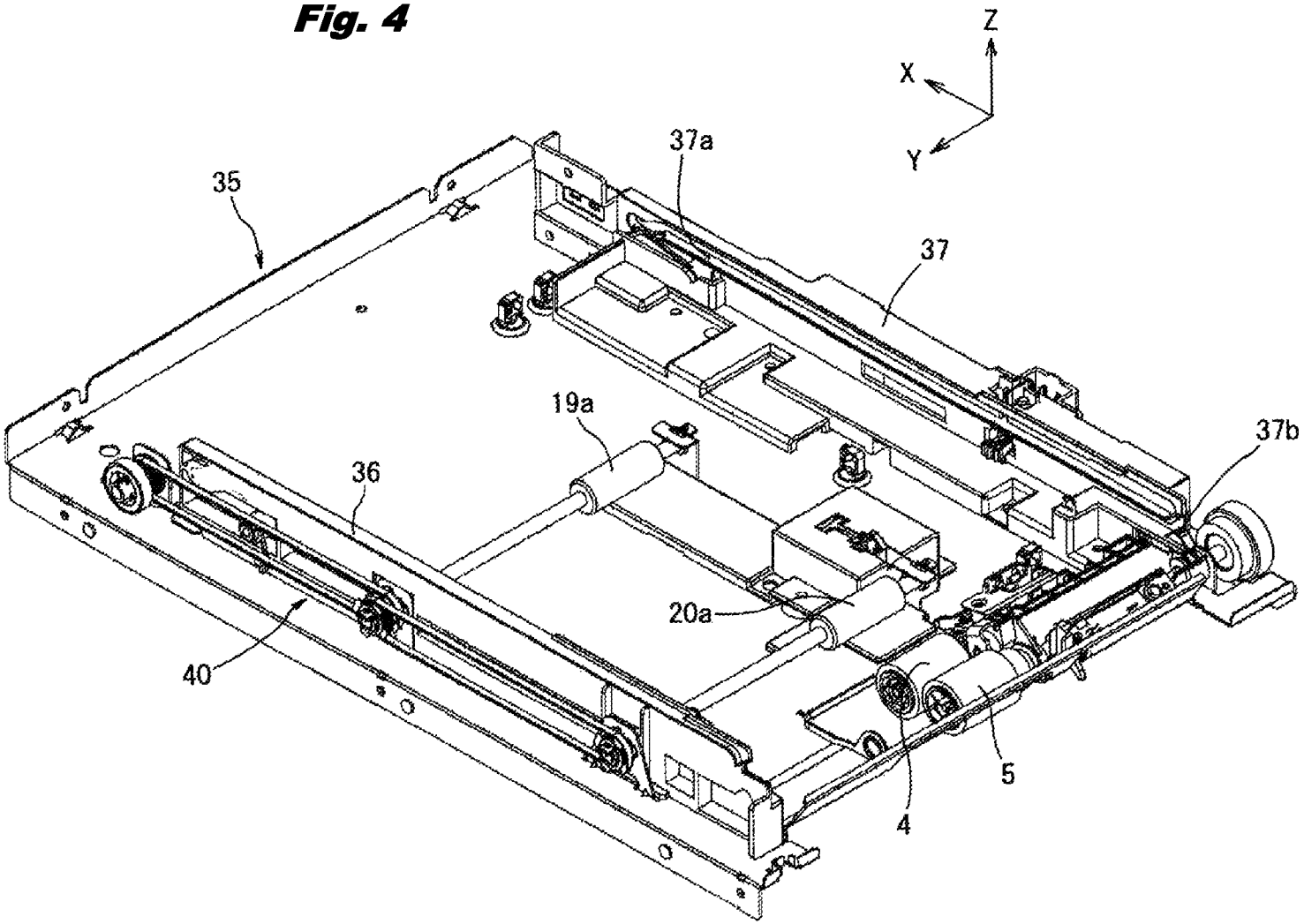
FIG. 4 illustrates an external perspective view of the base unit excluding the duplex unit in the first embodiment.
Figure 5C:
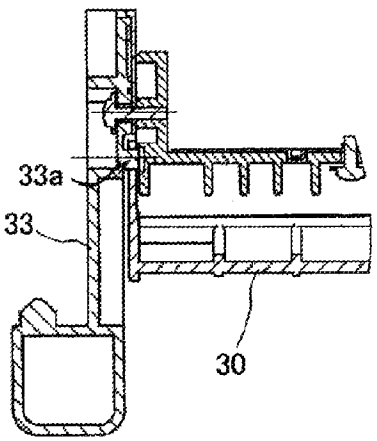
FIGS. 5A-5C illustrates configuration diagrams of the duplex unit in the first embodiment.
Figure 5A:
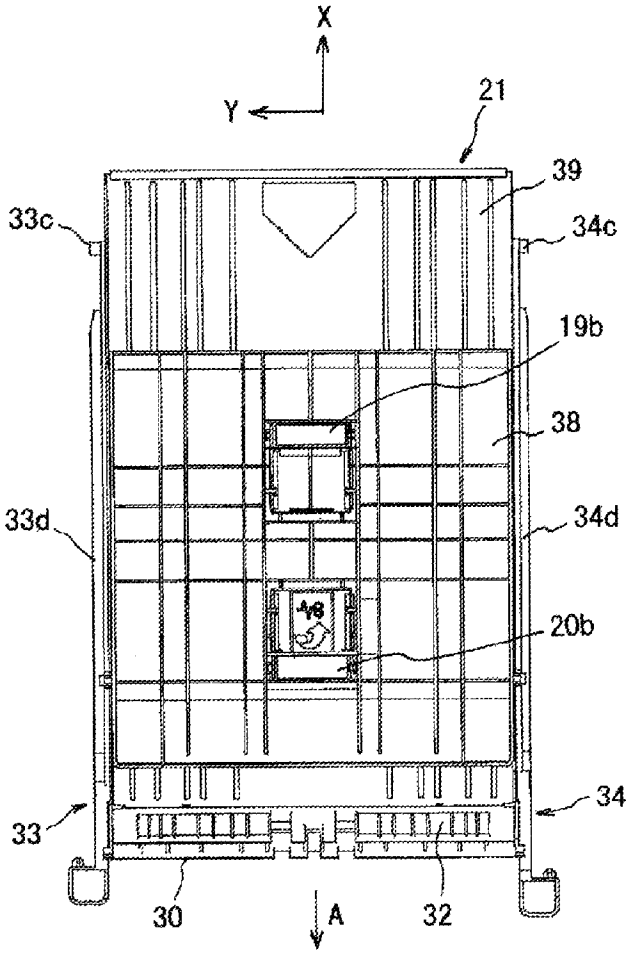
Figure 5B:
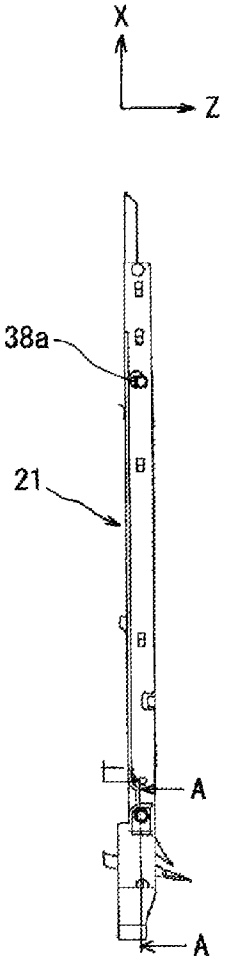

FIG. 2 illustrates an external perspective view of the duplex unit 21 and a base unit 35 that is fixed at a predetermined position inside the printer 1 and slidably holds the duplex unit 21. FIG. 3 illustrates an external perspective view illustrating a state when the duplex unit 21 is pulled out from the base unit 35 in the direction of the arrow A. FIG. 4 illustrates an external perspective view of the base unit 35 excluding the duplex unit 21. FIGS. 5A-5C illustrate configurations diagrams of the duplex unit 21. FIG. 5A illustrates a front view of the duplex unit 21; FIG. 5B illustrates a left side view of the duplex unit 21; and FIG. 5C illustrates a partial cross-sectional view illustrating a portion of an A-A cross section in the left side view of FIG. 5B.

As illustrated in FIG. 4, on the base unit 35 that is fixed on a body of the printer 1, a driving roller 19*a* of the carrying roller pair 19 and a driving roller 20*a* of the carrying roller pair 20 are rotatably held and a rotational force is transmitted via a drive transmission system 40 from the body of the printer 1. On two side of the base unit 35, an L rail 36 and R rail 37 are arranged opposing each other. On the rails 36, 37, guide grooves 36*a*, 37*a* and posts 36*b*, 37*b* that engage with predetermined parts (to be described later) of the duplex unit 21 are respectively arranged opposing each other.

However, in FIG. 4, only the guide groove 37*a* and the post 37*b* are illustrated. The guide groove 36*a* and the post 36*b* that are formed on the L rail 36 and the guide groove 37*a* and the post 37*b* that are formed on the R rail 37 are plane-symmetrically configured with respect to a virtual plane that perpendicularly intersects the base unit 35 at a central part in a width direction of the base unit 35.

As illustrated in FIG. 3, the duplex unit 21 is provided with a lower guide 39 and an upper guide 38 that are arranged opposing each other. The upper guide 38 that has a rotation supporting point 38*a* is rotatably attached to an L side guide 33 and R side guide 34 that are integrally formed with the lower guide 39, and is configured in a manner that a front end part of the upper guide 38 in the direction of the arrow A can rotate upward.

On the upper guide 38, a driven roller 19*b* of the carrying roller pair 19 and a driven roller 20*b* of the carrying roller pair 20 are rotatably held. As illustrated in FIG. 5, on the L side guide 33 and the R side guide 34 that are arranged on the two sides of the duplex unit 21, posts 33*c*, 34*c* that engage with the guide grooves 36*a*, 37*a* of the base unit 35 and ribs 33*d*, 34*d* that engage with the posts 36*b*, 37*b* of the base unit 35 are arranged.

Further, on the front end part of the duplex unit 21 in the direction of the arrow A (end portion on a downstream side in a pull-out direction of the duplex unit 21), an inner guide 30 as a guide member (to be described later) having rotation supporting points 31 (FIG. 6) is supported by the two side guides 33, 34 to be rotatable about an axis parallel to the Y axis direction using the rotation supporting points 31 as a rotation shaft. The L side guide 33 and the R side guide 34 are configured to be substantially plane-symmetrical with respect to a virtual plane that perpendicularly intersects the duplex unit 21 at a central part in a width direction of the duplex unit 21. As discussed here, the guide member is rotatably arranged with respect to the duplex unit 21.

The duplex unit 21 configured as described above has, for example, as illustrated in FIG. 3, the posts 33*c*, 34*c* respectively fitted in the base unit guide grooves 36*a*, 37*a* of the base unit 35 and the ribs 33*d*, 34*d* incorporated in a state of being respectively placed on the posts 36*b*, 37*b* of the base unit 35, and is slidably movable between a pulled-out position illustrated in FIG. 3 and an attachment position illustrated in FIG. 2. The direction of the arrow A indicates in this case the direction along which the duplex unit 21 is slid from the attachment position to the pulled-out position.

Figure 6:
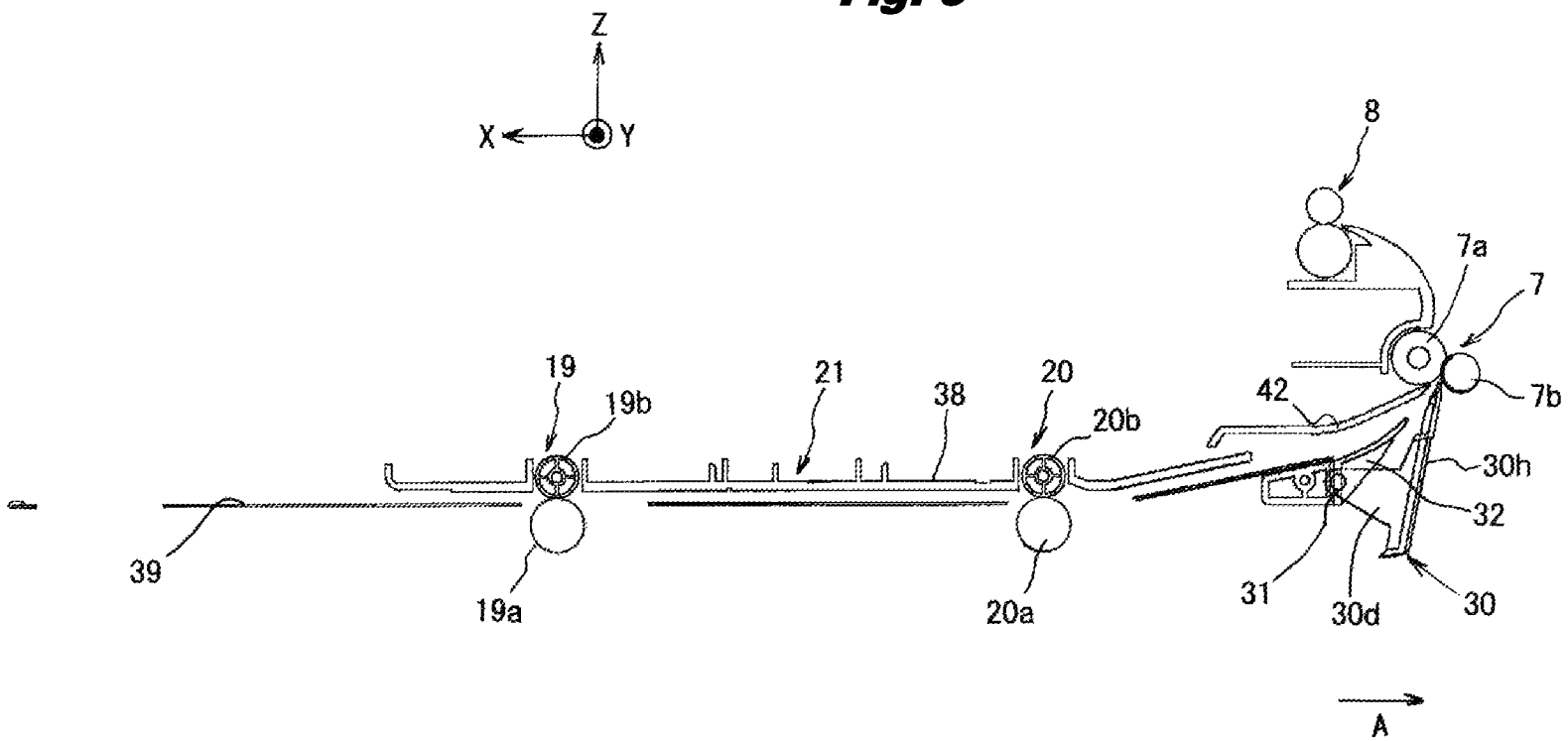
FIG. 6 illustrates a main part configuration diagram illustrating a carrying route of a recording sheet of the duplex unit in the first embodiment.
Figure 7A:
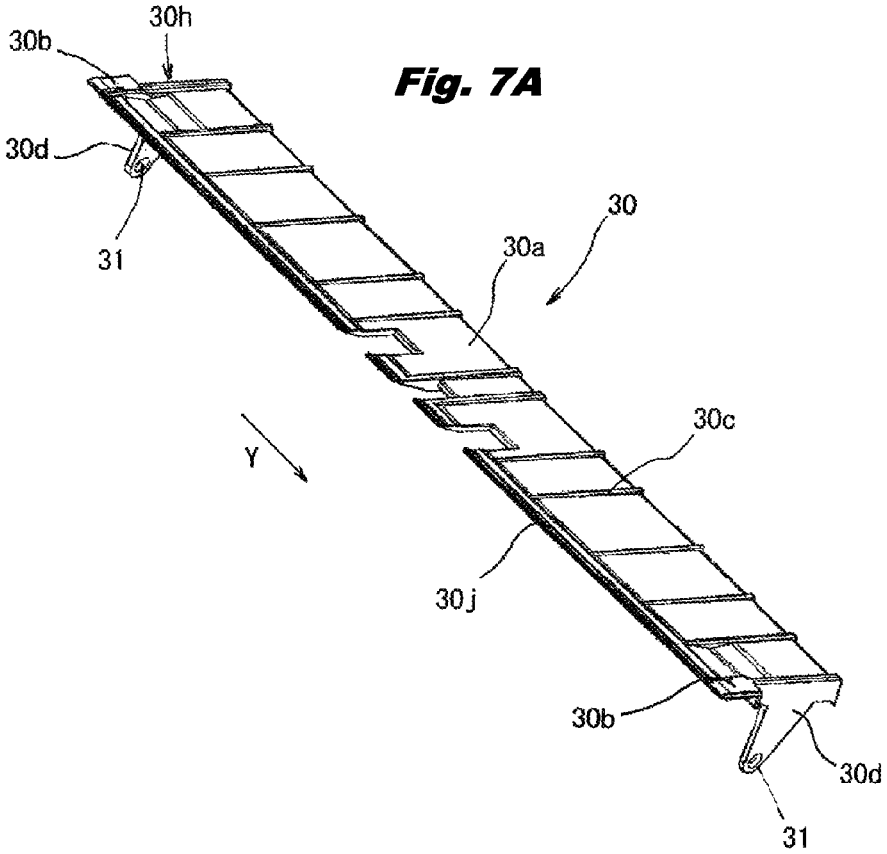
FIGS. 7A and 7B illustrate external perspective views of an inner guide viewed from different directions in the first embodiment.
Figure 7B:
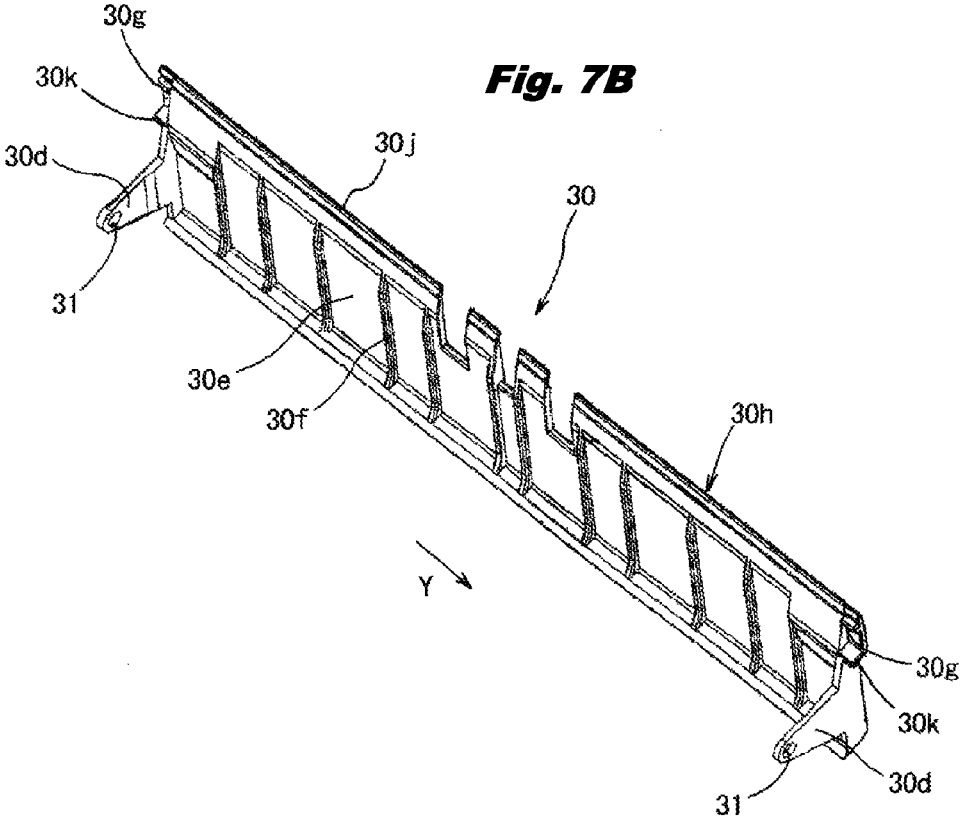

FIG. 6 illustrates a main part configuration diagram illustrating a carrying route of the recording sheet 2 of the duplex unit 21. FIGS. 7A and 7B illustrate external perspective views of the inner guide 30 viewed from different directions.

As illustrated in FIG. 6, when the duplex unit 21 is at the attachment position, the driven roller 19*b* and the driven roller 20*b* of the duplex unit 21 are respectively in contact with the driving roller 19*a* and the driving roller 20*a* of the base unit 35 to configure the carrying roller pairs 19, 20; and the recording sheet 2 is carried along a carrying route configured by the upper guide 38 and the lower guide 39 of the duplex unit 21. As will be described later, a front end part of the inner guide 30 is arranged close to a nip part of the first registration roller pair 7 by rotation associated with a closing operation of the front cover 28, and thus the inner guide 30 surely guides the recording sheet 2 (that is carried by the carrying roller pairs 19, 20 along the direction of the arrow A) to the nip part of the first registration roller pair 7.

FIG. 7A illustrates an external perspective view of the inner guide 30 viewed from a first carrying surface 30*a* side. FIG. 7B illustrates an external perspective view of the inner guide 30 viewed from a side of a second carrying surface 30*e* that is an opposite surface of the first carrying surface 30*a*.

As illustrated in FIGS. 7A and 7B, the inner guide 30 is as a whole in a plate shape which has longer sides in Y direction and has a medium regulation part 30*h*, two arm parts 30*d* and rotation supporting points 31. The medium regulation part 30*h* as a medium regulation part is a base component and has the first carrying surface 30*a* on one surface and the second carrying surface 30*e* that is formed on the opposite surface of the first carrying surface 30*a*. The arm parts 30*d* extend from both short sides of the medium regulation part 30*h* in a direction perpendicular to Y axis. The rotation supporting points 31 are respectively formed on tips of the arm parts 30*d* (or at side opposite to the medium regulation part 30*h*).

On the first carrying surface 30*a* of the medium regulation part 30*h*, ribs 30*c* that extend substantially parallel to the carrying direction of the recording sheet 2 are formed. Similarly, on the second carrying surface 30*e*, ribs 30*f* that extend substantially parallel to the carrying direction of the recording sheet 2 are formed. The pair of the arm parts 30*d* perpendicularly extend, in a manner opposing each other, from two end parts in a direction (the Y axis direction, which is a width direction of the inner guide 30) that substantially perpendicularly intersects a medium carrying direction of the medium regulation part 30*h*, are spaced apart with a distance larger than a maximum width of the recording sheet 2 that is carried, and are formed on the outside of a carrying area. The height of ribs 30*f* that is defined from the second carrying surface 30*e* is illustrated with Hf in FIG. 10.

Here, an example is described in which the pair of the arm parts 30*d* perpendicularly extends in a T-shape with respect to the medium regulation part 30*h*. However, the pair of the arm parts 30*d* may also be formed to extend in an L-shape, and as far as the pair of the arm parts 30*d* is formed to extend away from the medium regulation part 30*h*, the pair of the arm parts 30*d* may also be not perpendicular to the medium regulation part 30*h*.

In the width direction of the inner guide 30, on both end parts of the medium regulation part 30*h* on the first carrying surface 30*a* side, a pair of contact parts 30*b* is formed. The pair of the contact parts 30*b* are spaced apart with a distance larger than the maximum width of the recording sheet 2 that is carried, and are formed on the outside of the carrying area. Similarly, in the width direction of the inner guide 30, on both end parts of the medium regulation part 30*h* on the second carrying surface 30*e* side, a pair of abutting parts 30*g* is formed. The pair of the abutting parts 30*g* are spaced apart with a distance larger than the maximum width of the recording sheet 2 that is carried, and are formed on the outside of the carrying area.

Figure 8:
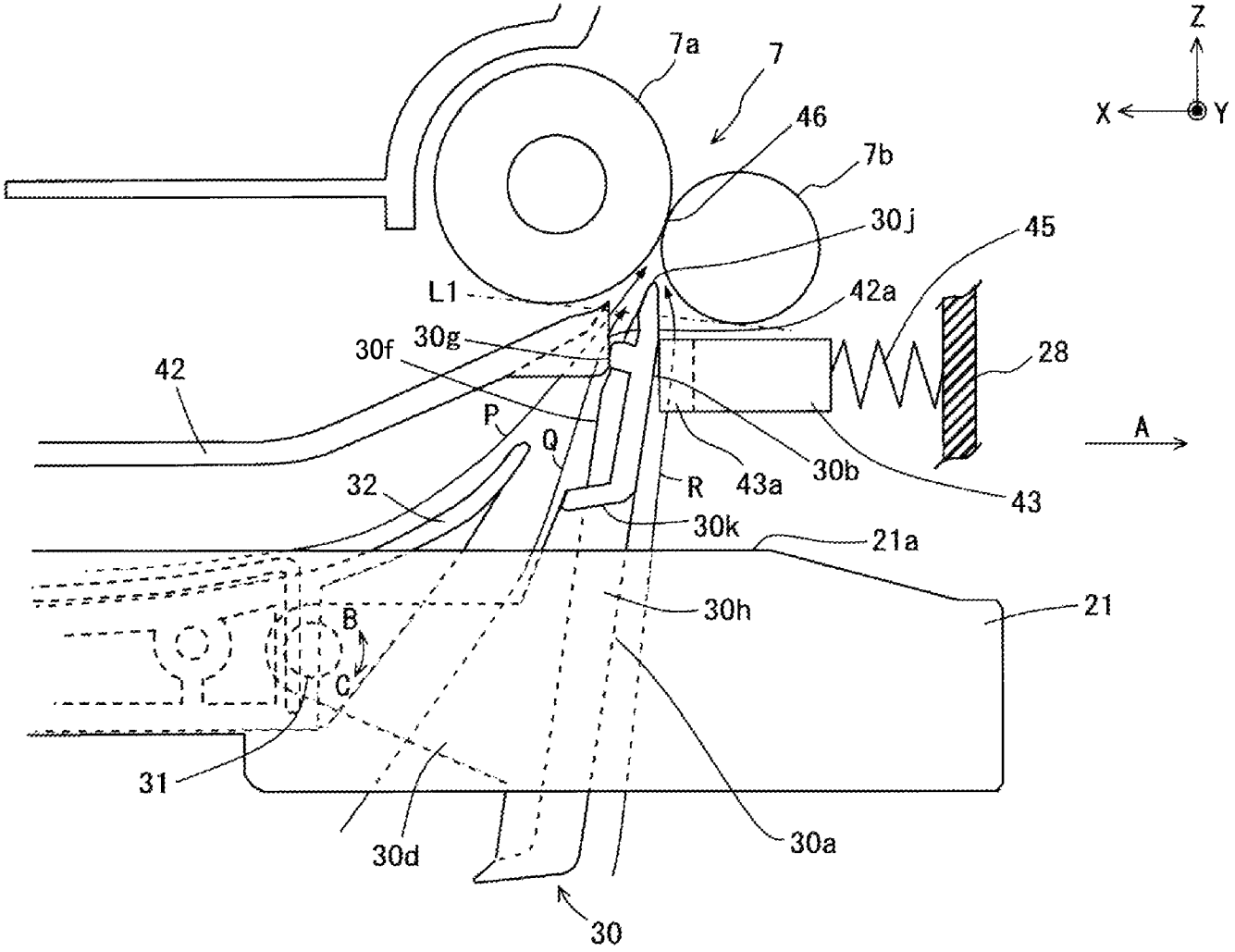
FIG. 8 illustrates a partial enlarged view illustrating a main part configuration in a vicinity of the inner guide in the first embodiment when a front cover is closed.
Figure 9:
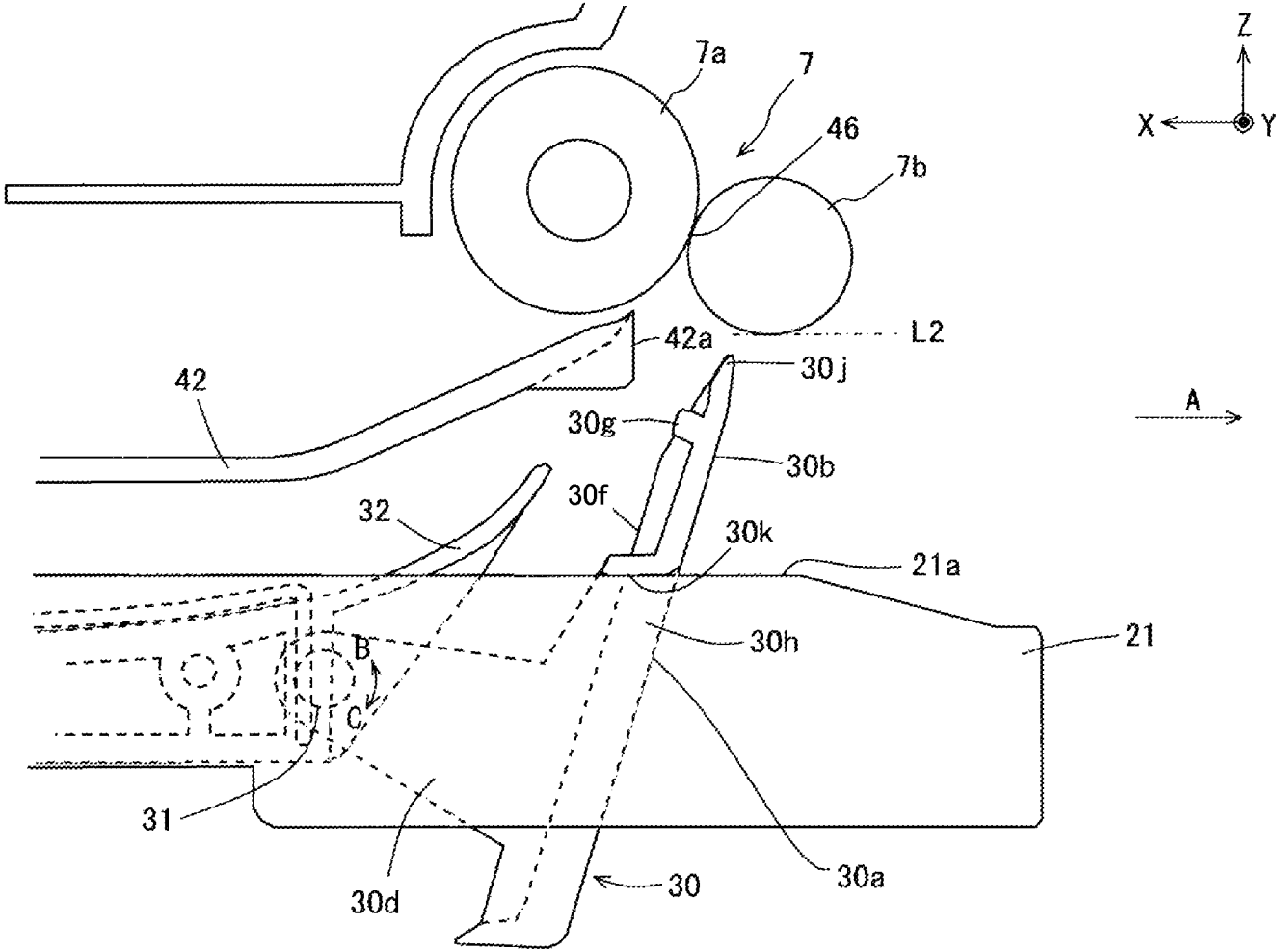
FIG. 9 illustrates a partial enlarged view illustrating a main part configuration in the vicinity of the inner guide in the first embodiment when the front cover is opened.

Next, a rotation operation of the inner guide 30 associated with an opening and closing operation of the front cover 28 is further described. FIG. 8 illustrates a partial enlarged view illustrating a main part configuration in a vicinity of the inner guide 30 when the front cover 28 is closed (at a close position). FIG. 9 illustrates a partial enlarged view illustrating a main part configuration in the vicinity of the inner guide 30 when the front cover 28 is opened.

First, as illustrated in FIG. 8, a state in which the front cover 28 is closed is described. In this case, the duplex unit 21 is positioned and fixed at the attachment position in the printer 1 by the base unit 35. The first registration roller pair 7 arranged in the printer 1 is configured by a driving roller 7*a* as a first roller that rotates by receiving a drive force and a driven roller 7*b* as a second roller that is driven by being in contact with the driving roller 7*a*.

Below the driving roller 7*a*, a pair of positioning contact parts 42*a*, which are fixed to the body of the printer 1, are formed as a second contact part on a front end part of a guide frame 42 and, following the upper guide 38 of the duplex unit 21, guides an upper side of the recording sheet 2 (that is carried through the duplex unit 21) to the first registration roller pair 7. The pair of the positioning contact parts 42*a* are formed at two end parts in the Y axis direction of the guide frame 42 in a manner opposing each other, are spaced apart with a distance larger than the maximum width of the recording sheet 2 that is carried, and are formed on the outside of the carrying area. The recording sheet 2, which is carried along a carrying route P shown in the figure, passes between the pair of the positioning contact parts 42*a*, are transferred to the first registration roller pair 7, which is located at a downstream side.

The pair of the abutting parts 30*g* of the inner guide 30 that is pressed by a pressing member 43 (to be described later) are respectively in contact with the pair of the positioning contact parts 42*a* so that rotation in a direction of an arrow B is regulated, and thus the inner guide 30 is positioned at this guide position. In this case, it is ensured that a front end part 30*j* of the medium regulation part 30*h* of the inner guide 30 that is formed in a wedge shape is arranged to be close to a nip part 46 as a contacting portion between the driving roller 7*a* and the driven roller 7*b*.

The pressing member 43 as a first contact part is provided with a pair of pressing projections 43*a* in a manner opposing each other at two end parts in the Y axis direction at a front-end side of the pressing member 43, and is held on the front cover 28 by a holding means (not illustrated in the drawings), for example, slidable in a direction perpendicular to the front cover 28. A coil spring 45 as a bias member is arranged between the pressing member 43 and the front cover 28. As illustrated in FIG. 8, in the state in which the front cover 28 is closed, the pair of the pressing projections 43*a* of the pressing member 43 that is biased by the coil spring 45 in a compressed state are respectively pressed against the pair of the contact parts 30*b* of the inner guide 30. Therefore, the inner guide 30 is positioned at the guide position illustrated in FIG. 8 by being sandwiched by the positioning contact parts 42*a* and the pressing projections 43*a* and is firmly maintained at this position.

Here, the front end part 30*j* of the inner guide 30 is arranged between the nip part 46 of the first registration roller pair 7 and an outer-circumference tangent line L1 of the driving roller 7*a* and the driven roller 7*b*. However, the front end part 30*j* is arranged at a position that forms predetermined gaps with respect to the driving roller 7*a* and the driven roller 7*b* in order to secure medium carrying routes P, Q, R. As a result, the carrying direction is regulated by guiding the recording sheet 2 that is carried toward the first registration roller pair 7 until immediately before the nip part 46. Thereby, medium carrying characteristics can be improved.

As described above, the positioning contact parts 42*a*, the abutting parts 30*g*, the contact parts 30*b* and the pressing projections 43*a* are arranged at positions that allow them to oppose each other. However, further, it is preferred that, as illustrated in FIG. 8, positions of opposing parts in the state in which the positioning contact parts 42*a*, the abutting parts 30*g*, the contact parts 30*b* and the pressing projections 43*a* oppose each other are arranged to be in a vicinity of the front end part 30*j* of the inner guide 30 and closer to the front end part 30*j* than the rotation supporting points 31. By adopting such an arrangement, it is possible to reduce positional variation of the front end part 30*j* due to factors such as vibration.

Here, carrying routes of the recording sheet 2 that is guided to the first registration roller pair 7 when the inner guide 30 is at the guide position are described. The recording sheet 2 that is carried by the carrying roller pairs 19, 20 (FIG. 6) in order to perform duplex printing is guided to the first registration roller pair 7 along the carrying route P that is guided by the guide frame 42 fixed on the body of the printer 1, a front end guide part 32 of the duplex unit 21 and the second carrying surface 30*e* of the inner guide 30. The recording sheet 2 that is brought out one by one from the sheet feeding cassette 3 (FIG. 1) by the sheet feeding roller 5 and the retard roller 6 is guided to the first registration roller pair 7 along the carrying route Q that is guided by the front end guide part 32 and the second carrying surface 30*e*. The recording sheet 2 that is fed and carried from the optional sheet feeding cassette 29 (FIG. 1) is guided to the first registration roller pair 7 along the carrying route R that is regulated by the first carrying surface 30*a* of the inner guide 30.

Next, as illustrated in FIG. 9, a state in which the front cover 28 is opened is described. When the front cover 28 is opened, the biasing force on the inner guide 30 due to the pressing member 43 is released so that the inner guide 30 rotates in a direction of an arrow C due to its own weight and transits from the guide position illustrated in FIG. 8 to a retreat position illustrated in FIG. 9.

In this case, when the inner guide 30 is at the guide position, the arm parts 30*d* of the inner guide 30 extend in a substantially horizontal direction and the medium regulation part 30*h* of the inner guide 30 extends in a substantially vertical direction. Therefore, a position of the gravity center of the inner guide 30 is offset to the side of the medium regulation part 30*h* more than the rotation supporting points 31. Therefore, when the front cover 28 is opened, the inner guide 30 rotates in the direction of the arrow C (opening direction) due to its own weight and transits to the retreat position illustrated in FIG. 9.

In this case, the rotation of the inner guide 30 in the direction of the arrow C is regulated by that abutting parts 30*k* formed on two end parts of the inner guide 30 in the width direction (Y axis direction) and rotation regulating parts 21*a* as a third contact part formed on the duplex unit 21 are in contact with each other, so that the inner guide 30 is positioned at the retreat position illustrated in FIG. 9 and remains at this position. Further, when the inner guide 30 is at the retreat position, the front end part 30*j* of the inner guide 30 is positioned vertically below an outer-circumference tangent line L2 of the driven roller 7*b*, the outer-circumference tangent line L2 being parallel to the direction of the arrow A, which is the pull-out direction of the duplex unit 21. As a result, when the duplex unit 21 is pulled out in the direction of the arrow A, the inner guide 30 and the driven roller 7*b* do not come into contact with each other. As discussed here, the duplex unit 21 is detachable or slidable with respect to the body of apparatus. In FIG. 1, the body of apparatus is very simply illustrated with the outer grid line of reference 1. The outer grid line indicates the structure of the body.

Therefore, when the recording sheet 2 that is carried is jammed in the duplex unit 21, as illustrated in FIG. 3, by pulling out the duplex unit 21 from the base unit 35 in the direction of the arrow A and rotating the upper guide 38 upward at outside of the printer 1 to open the inside of the duplex unit 21, the recording sheet 2 jammed in the duplex unit 21 can be removed.

Figure 10:
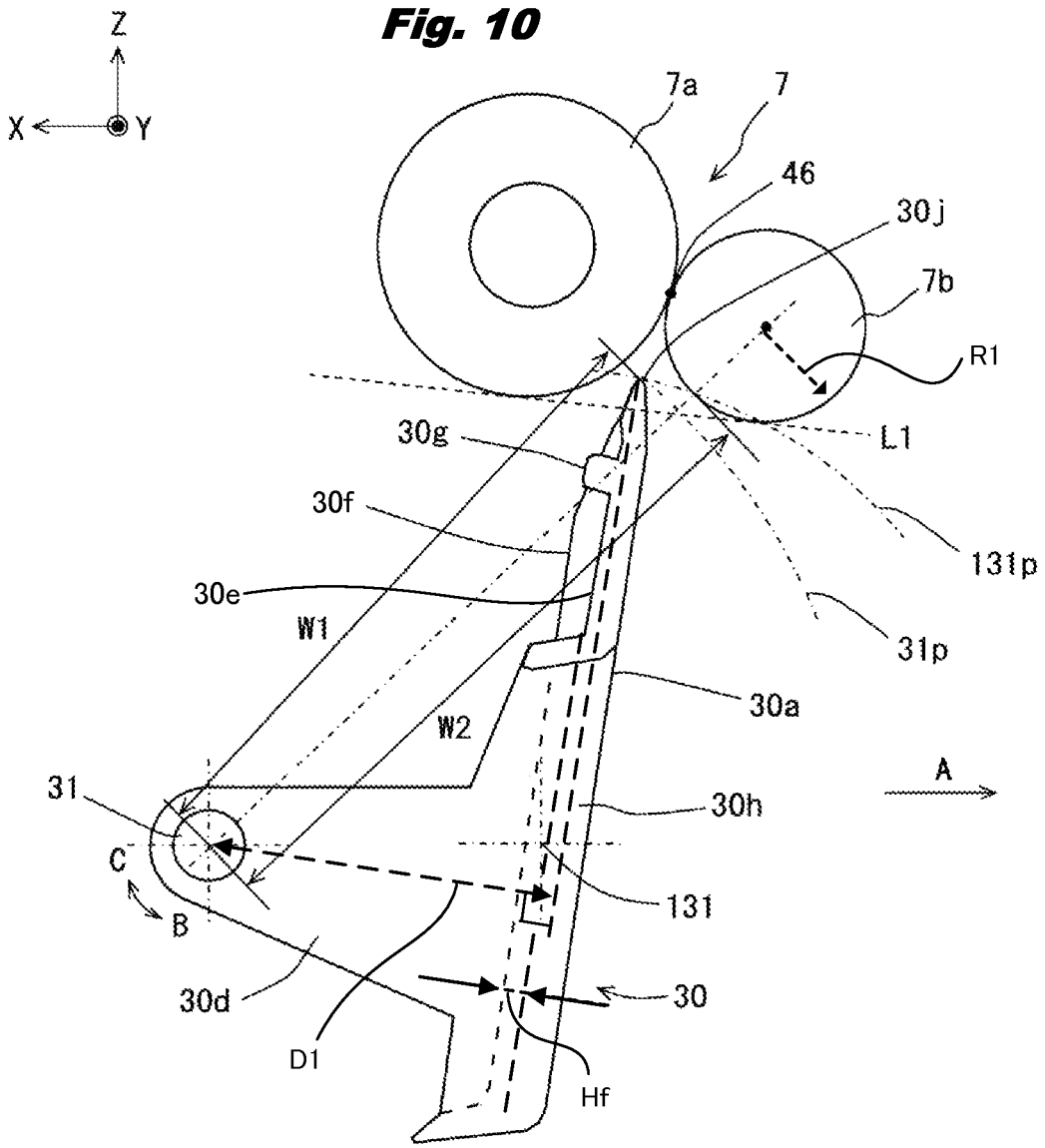
FIG. 10 illustrates an explanatory diagram for describing a shape and an attachment position of the inner guide in the first embodiment.

FIG. 10 illustrates an explanatory diagram for describing a shape and an attachment position of the inner guide 30. With reference to FIG. 10, the shape and the attachment position of the inner guide 30 are further described.

FIG. 10 illustrates a state in which the inner guide 30 is supported by the body of the duplex unit 21, which is positioned at the attachment position in the printer 1, to be rotatable about an axis parallel to the Y axis using the rotation supporting points 31 as a rotation shaft, and is further maintained by the above-described pressing member 43 at the guide position in which the abutting parts 30*g* of the inner guide 30 are in contact with the positioning contact parts 42*a* (see FIG. 8).

In this case, the front end part 30*j* of the inner guide 30 is arranged between the nip part 46 of the first registration roller pair 7 and the outer-circumference tangent line L1 of the driving roller 7*a* and the driven roller 7*b*, which is positioned at the lower part of the pair 7. It is necessary to attach the rotation supporting points 31 that are used as a center of rotation in such a manner that the front end part 30*j* of the inner guide 30 does not come into contact with the driven roller 7*b*, which is positioned on a downstream side, when the inner guide 30 rotates in the direction of the arrow C from the guide position to the retreat position illustrated in FIG. 9. For example, when the rotation supporting points 31 are attached at the position illustrated in FIG. 10, the front end part 30*j* draws a rotation path 31*p* and thus does not come into contact with the driven roller 7*b*. When the inner guide 30 rotates from the guide position in the direction of the arrow C, in an initial stage of the rotation, particularly the vicinity of the front end part 30*j* of the medium regulation part 30*h* moves in substantially the direction of the arrow A. Therefore, for convenience, this may be sometimes expressed as rotating in the direction of the arrow A.

As described above, in order to avoid contact between the front end part 30*j* and the driven roller 7*b*, when a distance from the rotation supporting point 31 to the front end of the front end part 30*j* is W1 and a shortest distance from the rotation supporting point 31 to the driven roller 7*b* that is positioned on a downstream side more than the front end part 30*j* in the rotation direction (on the side of the direction of the arrow A) is W2, the rotation supporting point 31 of the inner guide 30 is positioned at a position such that $$W1<W2$$

is satisfied.

In contrast, as a comparative example, when the center of rotation of the inner guide 30 is moved, for example, to a virtual center 131 that overlaps with the medium regulation part 30*h*, since W1>W2 and the front end part 30*j* draws a rotation path 131*p*. Therefore, the front end part 30*j* comes into contact with the driven roller 7*b* so that the inner guide 30 cannot rotate to the retreat position.

Therefore, in the inner guide 30 of the present embodiment that has the flat plate-shaped medium regulation part 30*h* that includes the front end part 30*j*, the first carrying surface 30*a* and the second carrying surface 30*e* formed on the opposite side of the first carrying surface 30*a*, the arm parts 30*d* are arranged on the two end parts of the medium regulation part 30*h* in the width direction extending in a direction away from the medium regulation part 30*h*, and the rotation supporting points 31 are formed on front end parts of the arm parts 30*d*. The arm parts 30*d* are arranged to extend on the side of the medium regulation part 30*h* at the guide position that is opposite to the driven roller 7*b* (on the side of the driving roller 7*a*), that is, the opposite side of the side of the direction of the arrow A, and are attached to the body of the duplex unit 21. The driven roller 7*b* in this case is positioned on the downstream side in the rotation direction (the direction of the arrow A) when the inner guide 30 rotates from the guide position to the retreat position in the direction of the arrow C.

Further, in the inner guide 30 that is formed as described above, its gravity center is offset to the side of the medium regulation part 30*h* more than the rotation supporting points 31. Therefore, due to its own weight, the inner guide 30 can rotate in the direction of the arrow C to the above-described retreat position.

As described above, according to the printer of the present embodiment, it is possible to allow the inner guide 30 that is rotatably supported on the body of the duplex unit 21 to approach, at the guide position, the vicinity of the nip part 46 of the first registration roller pair 7 in order to surely guide the recording sheet 2, and to rotate to the retreat position to allow the duplex unit 21 to be pulled out without interfering with the driven roller 7*b* of the first registration roller pair 7.

Further, at the retreat position, the first registration roller pair 7 and the inner guide 30 are spaced apart from each other. Therefore, a medium jammed in the vicinity of the first registration roller pair 7 can be easily removed. Further, the inner guide 30 is provided on an end part on a pull-out side of the duplex unit 21 (the direction of the arrow A). Therefore, by pulling out the duplex unit 21 for only a small amount, a medium jammed in a vicinity of the inner guide 30 can be even more easily removed and the pulling out of the duplex unit 21 can be easily performed.

Second Embodiment

Figure 11:
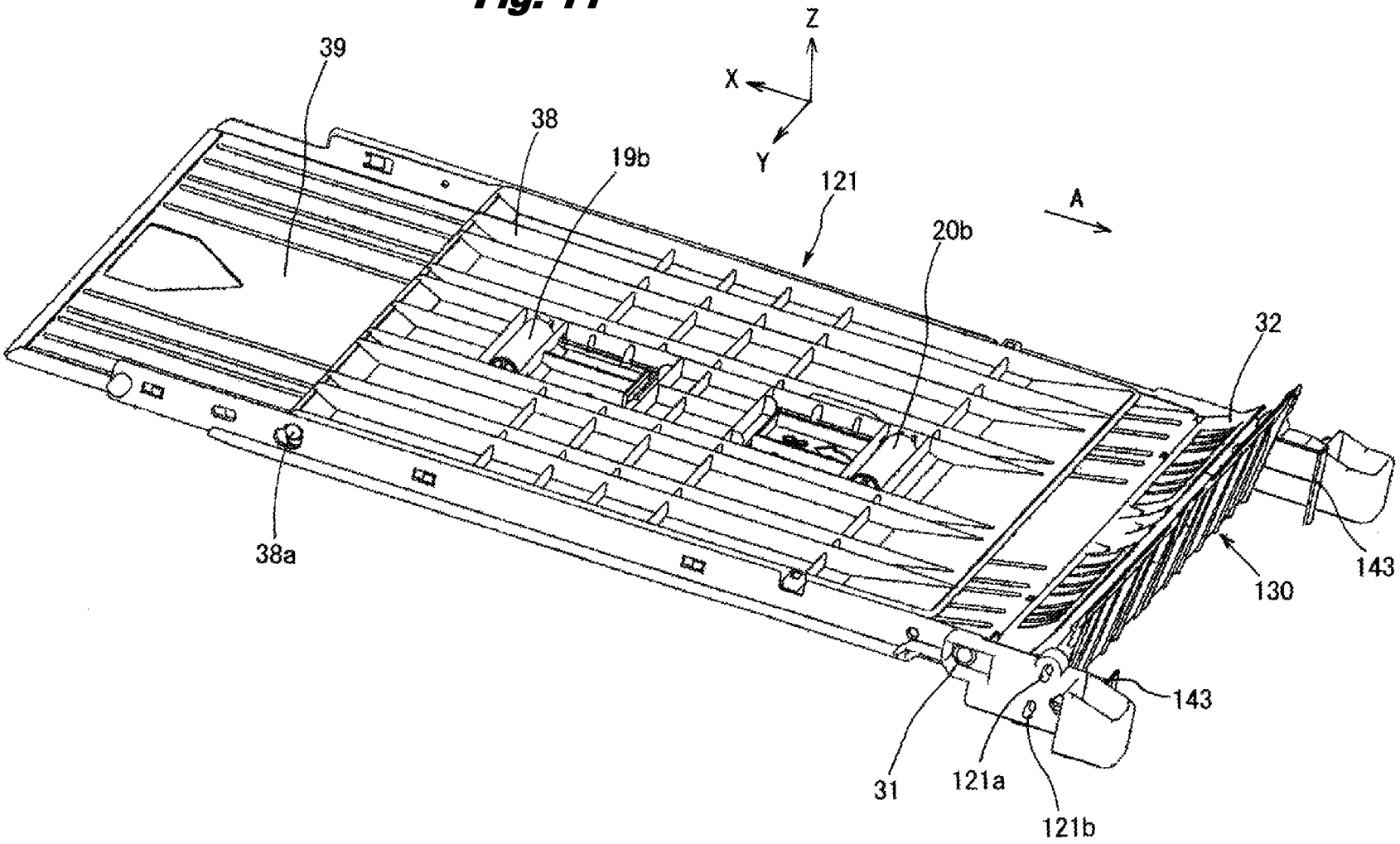
FIG. 11 illustrates an external perspective view of a duplex unit adopted by a printer of a second embodiment based on the present invention.
Figure 12C:
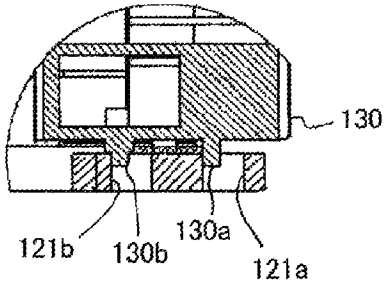
FIGS. 12A-12C illustrates configuration diagrams of the duplex unit in the second embodiment.
Figure 12A:
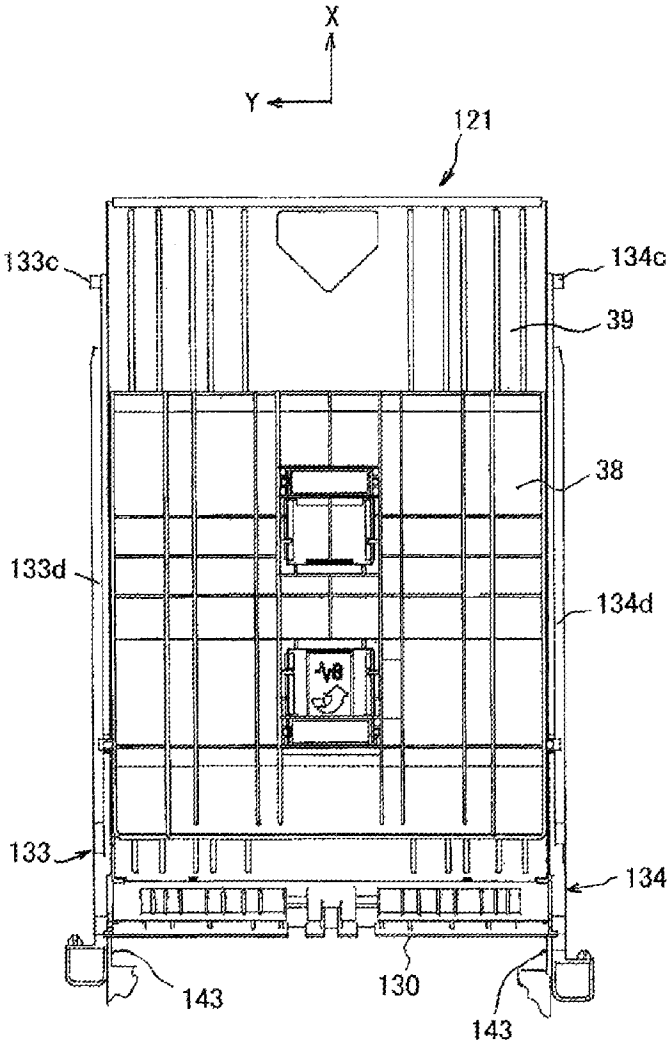
Figure 12B:
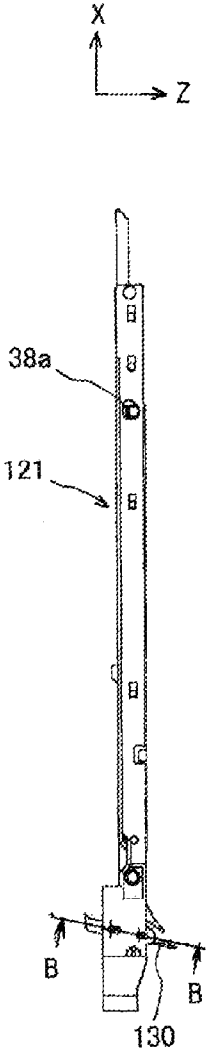

FIG. 11 illustrates an external perspective view of a duplex unit 121 adopted by a printer of a second embodiment based on the present invention. FIGS. 12A-12C illustrate configurations diagrams of the duplex unit 121. FIG. 12A illustrates a front view of the duplex unit 121; FIG. 12B illustrates a left side view of the duplex unit 121; and FIG. 12C illustrates a partial cross-sectional view illustrating a portion of a B-B cross section in the left side view of FIG. 12B.

Main differences between the printer adopting the duplex unit 121 and the above-described printer 1 illustrated in FIG. 1 are a shape, an attachment method and operation details of an inner guide 130 as a guide member in the duplex unit 121. Therefore, for the printer adopting the duplex unit 121, parts that are in common with the above-described printer 1 (FIG. 1) of the first embodiment are denoted using the same reference numeral symbols, or are omitted from the drawings and their description is omitted, and the differences are mainly described. Further, a main part configuration of the printer of the present embodiment, excluding the duplex unit 121, is in common with the main part configuration of the printer 1 of the first embodiment illustrated in FIG. 1. Therefore, refer to FIG. 1 as needed.

On a front end part in the direction of the arrow A of the duplex unit 121 of the present embodiment, the inner guide 130 (to be described later) having posts 130*a*, 130*b* on both end parts in a direction (width direction of the inner guide 130) that substantially perpendicularly intersects the medium carrying direction is supported to be slidable in a substantially up-down direction by guide long holes 121*a*, 121*b* that are respectively formed on two side guides 133, 134. The side guide L133 and the side guide R134, and the inner guide 130, are configured to be substantially plane-symmetrical with respect to a virtual plane that perpendicularly intersects the duplex unit 121 at a central part in the width direction of the duplex unit 121.

Figure 13A:
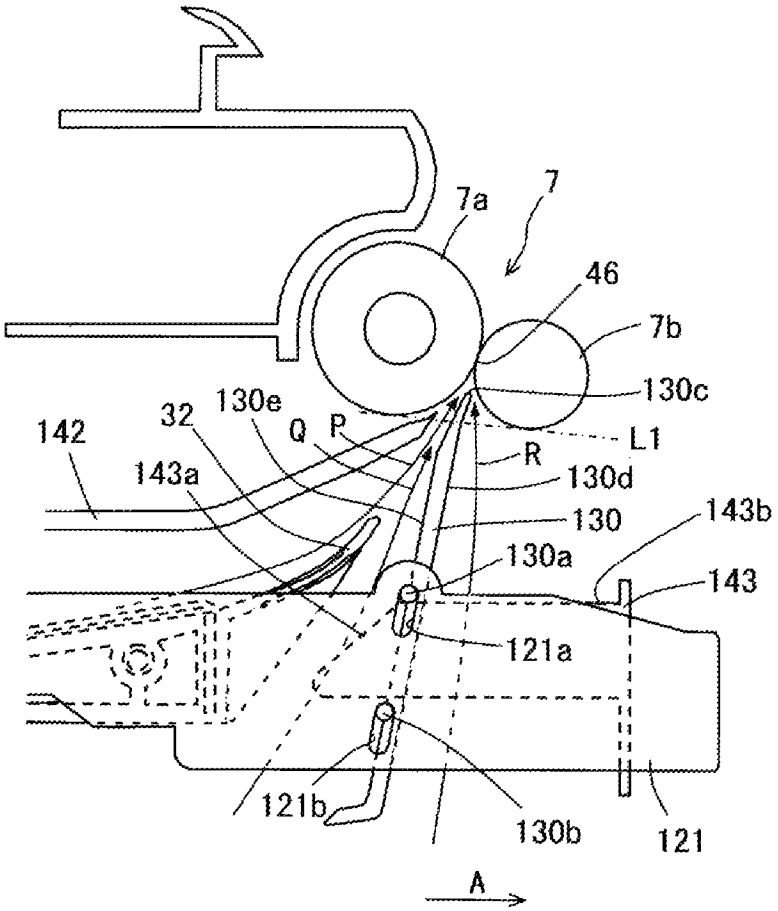
FIG. 13A illustrates a partial enlarged view illustrating a main part configuration in a vicinity of an inner guide in the second embodiment when a front cover is closed.
Figure 13B:
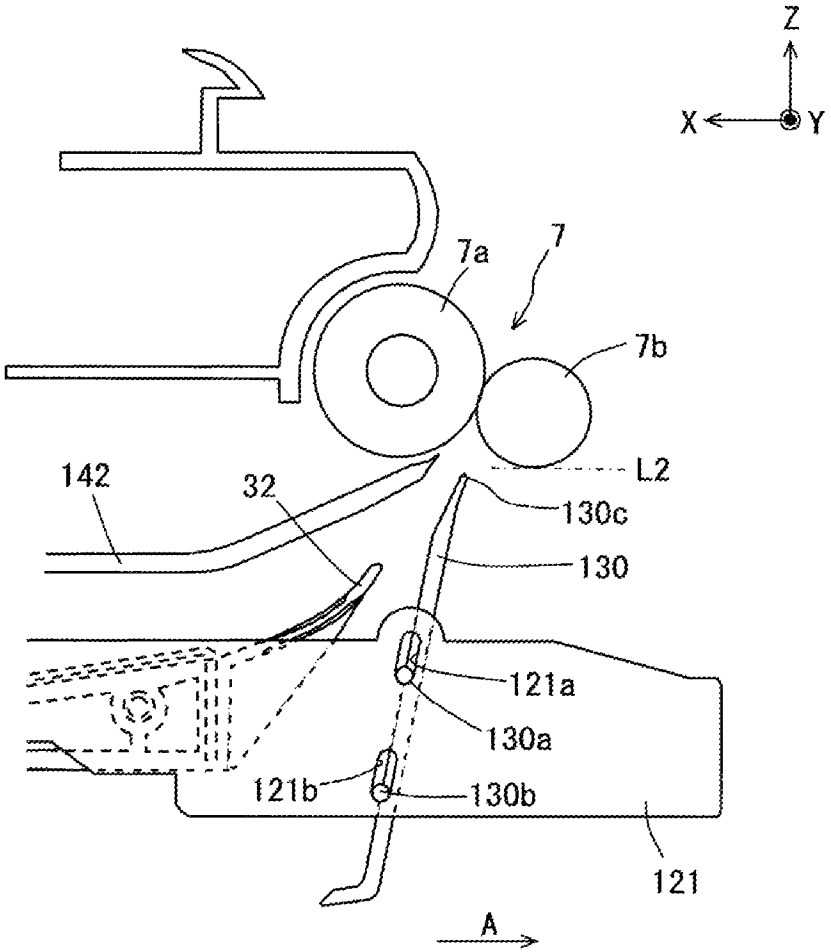
FIG. 13B illustrates a partial enlarged view illustrating the main part configuration in the vicinity of the inner guide in the second embodiment when the front cover is opened.

Next, an up-down movement operation of the inner guide 130 associated with an opening and closing operation of the front cover 28 (FIG. 1) is described. FIG. 13A illustrates a partial enlarged view illustrating a main part configuration in a vicinity of the inner guide 130 when the front cover 28 is closed. FIG. 13B illustrates a partial enlarged view illustrating the main part configuration in the vicinity of the inner guide 130 when the front cover 28 is opened.

First, as illustrated in FIG. 13B, a state in which the front cover 28 is opened is described. In this case, due to its own weight, the inner guide 130 is in a lowermost position of an up-down movable range that corresponds to a retreat position. When the inner guide 130 is in the retreat position, it is ensured that a front end part 130*c* of the inner guide 130 is positioned vertically below the outer-circumference tangent line L2 of the driven roller 7*b*, the outer-circumference tangent line L2 being parallel to the direction of the arrow A, which is the pull-out direction of the duplex unit 121. As a result, when the duplex unit 121 is pulled out in the direction of the arrow A, the inner guide 130 and the driven roller 7*b* do not come into contact with each other.

When the front cover 28 is closed from this state, during this process, an engagement projection 143 (see FIG. 13A) arranged on the front cover 28 approaches the post 130*a* of the inner guide 130 from an opposite direction of the arrow A, and first an inclined part 143*a* of the engagement projection 143 comes into contact with the post 130*a* to push the post 130*a* upward along the guide long hole 121*a*. Therefore, along with this, the entire inner guide 130 rises.

When the front cover 28 is eventually closed, as illustrated in FIG. 13A, the post 130*a* rises over the inclined part 143*a* to reach a horizontally formed upper side 143*b* of the engagement projection 143 and is in a state of being placed on the upper side 143*b*. A sliding position of the inner guide 130 in this case corresponds to the guide position.

When the inner guide 130 is at this guide position, the front end part 130*c* of the inner guide 130 is arranged between the nip part 46 of the first registration roller pair 7 and the outer-circumference tangent line L1 of the driving roller 7*a* and the driven roller 7*b*. However, the front end part 130*c* is arranged at a position with respect to the driving roller 7*a* and the driven roller 7*b* that forms predetermined gaps in order to secure the medium carrying routes P, Q, R. As a result, the carrying direction is regulated by guiding the recording sheet 2 that is carried toward the first registration roller pair 7 until immediately before the nip part 46. Thereby, medium carrying characteristics can be improved.

Here, carrying routes of the recording sheet that is guided to the first registration roller pair 7 when the inner guide 130 is at the guide position are described. The recording sheet 2 that is carried by the carrying roller pairs 19, 20 (FIG. 6) in order to perform duplex printing is guided to the first registration roller pair 7 along the carrying route P that is guided by a guide frame 142 fixed on the body of the printer 1, the front end guide part 32 of the duplex unit 121 and a second carrying surface 130*e* of the inner guide 130. The recording sheet 2 that is brought out one by one from the sheet feeding cassette 3 (FIG. 1) by the sheet feeding roller 5 and the retard roller 6 is guided to the first registration roller pair 7 along the carrying route Q that is guided by the front end guide part 32 and the second carrying surface 130*e*. The recording sheet 2 that is fed and carried from the optional sheet feeding cassette 29 (FIG. 1) is guided to the first registration roller pair 7 along the carrying route R that is regulated by a first carrying surface 130*d* of the inner guide 130.

As described above, according to the printer of the present embodiment, it is possible to allow the inner guide 130 that is slidably supported on a body of the duplex unit 121 to approach, at the guide position, the vicinity of the nip part 46 of the first registration roller pair 7 in order to surely guide the recording sheet 2, and to slide to the retreat position to allow the duplex unit 121 to be pulled out without interfering with the driven roller 7*b* of the first registration roller pair 7. Further, at the retreat position, the first registration roller pair 7 and the inner guide 130 are spaced apart from each other. Therefore, a medium jammed in the vicinity of the first registration roller pair 7 can be easily removed.

(1) Two Positions of Guide Member

In the above embodiments, the guide member (30, 130) is movable and takes two different positions. One is the guide position and the other is the retreat position. The two positions are realized in correspondence with open/close position of the cover (28). See FIGS. 8, 10 and 13A for the guide position, FIGS. 9 and 13B for the retreat position.

(1.1) Guide Position

At the guide position, the guide member is arranged close to two carrying parts (7*a* and 7*b*) so that the medium is delivered to the nip part of the carrying parts.

When the guide member is attached to the unit (21, 121), it is preferred that the front end part (30*j*, 130*c*) of the guide member is located above the outer-circumference tangent line (L2) of the carrying part at the bottom. The carrying part is one that is positioned at the downstream side of the pull-out direction of the unit, see FIG. 9, because the closer the inner guide is, the more securely the medium can be delivered to the nip part. Further, it is more preferred that the inner guide is positioned above the connecting line (L1) that is an imaginary line connecting the outer circumferences of the two carrying parts at the bottoms. According to the above preferred embodiments, the guide member is disclosed to be positioned at the guide position at states where the cover is fully closed and where the unit is fully inserted.

(1.2) Retreat Position

At the retreat position, the guide member is arranged away from the carrying parts. The front end part also is away from the nip part so that the medium is not delivered to the nip part.

When the guide member is attached to the unit, it is preferred that the front end part of the guide member is positioned below the outer-circumference tangent line (L2). That is because, when the unit is pulled out, moving rightward in FIG. 9, the front end part does not contacts the carrying part. The unit can be easily taken out of the apparatus. According to the above preferred embodiments, the guide member is disclosed to be positioned at the retreat position at states where the cover is open (or not fully closed) and where the unit is not fully inserted.

(2) Moving in Correspondence with Open/Close of Cover

The bias member (or coil spring 45 for example) is positioned in the vicinity of the guide member, the bias member reacting in correspondence with open/close status of the cover so that the position of the guide member is switched according to with/without the biasing force generated with the bias member. When the cover is closed, the bias force directing to the same direction as the cover is closing is applied to the guide member so that the guide member remains at the guide position.

On the other hand, when the cover is opened, the bias force is not generated so that the guide member not having the bias force moves from the guide position to the retreat position due to its own weight. In order to realize the feature, the gravity center is, in a view of the width of the medium regulation part, not located vertically above the rotation supporting points. In a claim below, it is recited that the gravity center is not located above the distal ends of the arm parts. The "distal ends" does not necessary means the most distant portion of the arm parts. As long as a certain distance from the medium regulation part is obtained, any portion of the arm part can be interpreted as the distal ends.

Further, specific structures of distances D1 and W1 are disclosed below. The distance D1 is defined a length perpendicular from the rotation supporting point toward the medium regulation part. Putting it another way, the D1 is the shortest length from the rotation supporting point to the medium regulation part. The distance W1 is defined as a length from the rotation supporting point.

In view of securing a large distance from the carrying parts by moving to the retreat position, it is preferred to make the distance W1 as large as possible. Also, making the distance D1 large brings an advantage that a torque due to the own weight becomes large. On the other hand, making the distances W1 and D1 very large does not suit a design thought to make the apparatus compact.

(2.1) Distance W1

Considering those matters, it is preferred that the distance W1 ranges within 30 mm to 50 mm, more preferably around 40 mm. In a view of a proportion to radius R1 of the carrying part, it is preferred that the proportion of W1 to R1 (W1/R1) ranges within 600% to 1,000%, more preferably around 800%. Based on the proportion, it is assumed that a preferred R1 is around 5 mm.

(2.2) Distance D1

Similar to the distance W1, it is preferred that the distance D1 ranges within 10 mm to 30 mm, more preferably around 20 mm. In a view of a proportion to radius R1 of the carrying part, it is preferred that the proportion of D1 to R1 (D1/R1)

ranges within 200% to 600%, more preferably around 400%. Based on the proportion, it is assumed that a preferred R1 is around 5 mm.

(3) Carrying Part(s)

In the embodiments on the application, the carry of the medium (sheet) is realized with a pair of rollers (7*a*, 7*b*). However, other structures can be applied. For example, it is practical to use a combination of a drive roller and a panel, and a combination of a pair of panels that rub each other in order to carry the medium therebetween. Further, according to the embodiments above, the nip part 46 indicates a contact portion created by two rollers. However, the nip part is not necessarily limited to the contact portion. A contact portion by a roller and a panel and a contact portion by two panels as well are categorized in the nip part.

(4) Retreated Member

A retreated member of the invention, recited in Claim 14, is a part of configuration that is designed to carry the medium. The carrying part(s) discussed above is one example. More specifically, the pair of rollers 7*a* and 7*b* is categorized. As discussed above, not only a roller but a panel and panels also can be categorized in the retreated member.

(5) Three Carrying Routes P, Q, R

In the invention, three carrying routes P, Q, R for carrying the medium to the carrying parts (7*a*, 7*b*) that is positioned at the upstream side of these routes are designed, see FIGS. 8 and 13A. Route P is created with the guide frame (42 or 142) and the front end part 32. Route Q is created with the front end part 32 and the inner guide 30 or 130. Route R is created with the inner guide and the pressing member 43.

(5.1) Positioning Contact Part 42*a*

As illustrated in FIG. 8, the guide frame 42 has the positioning contact part 42*a* at one end that is at the downstream side so that the positioning contact part 42*a* is in contact with the abutting part 30*a* of the inner guide 30. As there is a pair of abutting parts 30*g* at the both sides of the guide frame 42 in the width direction (or Y direction in the figures) shown in FIG. 7B, the guide frame 42 has another positioning contact part 42*a* at the other side, which is not illustrated in FIG. 8 so that two of the positioning contact parts 42*a* respectively meet two of the abutting parts 30*g*. With the meeting, a grid space is created with the positioning contact parts 42*a*, guide frame 42, abutting parts 30*g* and inner guide 30. The distance between the positioning contact parts 42*a* in the width direction is set larger than a width of the medium. The distance between the abutting parts 30*g* in the width direction is also set larger than the width of the medium. Therewith, the positioning contact parts 42*a* and the abutting parts 30*g* are located outside the routes P and Q along which the medium passes. The dotted lines of routes P and Q at the positioning contact part 42*a* in FIG. 8 mean that the routes are sandwiched between the positioning contact parts 42*a* in the width view (Y direction view).

(5.2) Front End Guide Part 32

In the above embodiment, the front end guide part 32 does not has any portions that contact either the guide frame 32 or the inner guide 30. The front end guide part 32 has a shorter width than the distances of the positioning contact parts 42*a* and the abutting parts 30*g*. Thereby, the front end guide part 32 does not contribute to create the grid space. However, it is practical for the front end guide part 32 to have one or pair of projection portions at the side and to contribute to create another grid space for passing the medium or to guide the medium toward the downstream.

(5.3) Pressing Projections 43*a*

As illustrated in FIG. 8, the pressing member 43 has the pressing projection 43*a* at one end that is close to the inner guide 30 and at one side in the width direction so that the pressing projection 43*a* is in contact with the surface 30*a* of the inner guide 30. Even not illustrated, the pressing member 43 has another pressing projection 43*a* at the other side. Each of the pressing projections 43*a* contacts the surface 30*a* so that a grid space is created with the pressing projections 43*a* and pressing member 43 and the surface 30*a* of the inner guide 30. The distance between the pressing projections 43*a* in the width direction is larger than the width of the sheet. Therewith, the pressing projections 43*a* are located outside the route R along which the medium passes. The dotted line of route R at the pressing projection 43*a* in FIG. 8 means that the route is sandwiched between the pressing projections 43*a* in the width view.

In the embodiment illustrated in FIGS. 7A and 7B, the two arm parts 30*d* are arranged at the both sides of the inner guide 30, making it possible to carry the medium between the arm parts 30*d*. It is, however, not necessary to use two arm parts. As long as the rotation supporting point 31 (or rotation center) of the inner guide 30 is offset from the medium regulation part 30*h*, putting it another way, maintaining the distance D1 in FIG. 10, a single arm part or three ore more arm parts are available. For example, a single arm part can be disposed entirely in the lateral direction (Y direction) of the inner guide 30 so that a surface of the arm part as well forms a part of the medium carrying route. Such an arm part is preferred when the width of the inner guide 30 ranges within 10 to 20 mm, or when it is adopted for a small printer, for example, a printer designed to print price tags. A single arm part can be disposed in the middle of the width or multiple arm parts can be aligned in the width direction with certain intervals.

There are stable members and movable members in the application. It is clear by comparing FIGS. 8 and 9, and also FIGS. 13A and 13B that the inner guides 30 and 130 (or guide member) are movable with respect to the body of apparatus. The guide frames 42 and 142 and the front end guide part 32 are stable or not movable with respect to the body of apparatus.

INDUSTRIAL APPLICABILITY

In the above-described embodiments, the present invention is described using a black-and-white electrophotographic printer capable of performing duplex printing as an example. However, the present invention is not limited to this, but is also applicable to an image forming apparatus, such as a copying machine, a facsimile, or an MFP, that is capable of performing simplex printing or duplex printing. Further, a black-and-white printer is described, but the printer may also be a color printer.

What is claimed is:

1. A medium carrying device, comprising:

a first carrying part and a second carrying part that are configured to carry a medium, contact each other and make a nip part therebetween;

a cover member that is pivotal to open and close with respect to a body of the medium carrying device; and a guide member that is positioned at a guide position to guide the medium toward the nip part, wherein the guide member comprises a medium regulation part that has a front end part facing the nip part when the guide member is at the guide position;

an arm part that extends from the medium regulation part; and a rotation center that is formed on a distal end side of the arm part that is opposite from a medium regulation part side of the arm part, the guide member is rotatable from the guide position in a direction in which the front end part approaches the second carrying part with respect to the body of the medium carrying device, the rotation center is positioned at a first carrying part side, the guide member rotates between the guide position and a retreat position where the guide member is retreated from the guide position in correspondence with open movements of the cover member, a position of the rotation center is maintained while the guide member rotates with respect to the body of the medium carrying device, the rotation center of the guide member when the guide member is at the guide position is substantially at the same position as the position of the rotation center of the guide member when the guide member is at the retreat position, a distance between the rotation center of the guide member and at least one of the first carrying part and the second carrying part is kept constant while the guide member rotates from the guide position to the retreat position, wherein the first carrying part is a first carrying roller, and the second carrying part is a second carrying roller, wherein when the guide member is at the guide position, the front end part of the medium regulation part is positioned, in a width view of the medium regulation part, between the nip part and a lower outer-circumference tangent line (L1) of the first roller and the second roller, and wherein when the guide member is at the retreat position, the front end part of the medium regulation part is not positioned, in a width view of the medium regulation part, between the nip part and the lower outer-circumference tangent line (L1) of the first roller and the second roller.

2. The medium carrying device according to claim 1, wherein when the guide member is at the guide position, the medium regulation part is sandwiched by a first contact part that is formed on the cover member and a second contact part that is fixedly arranged with respect to the body of the medium carrying device.

3. The medium carrying device according to claim 2, wherein the first contact part and the second contact part sandwich the medium regulation part in a vicinity of the front end part of the medium regulation part.

4. The medium carrying device according to claim 1, further comprising:

a bias member that applies a bias force between the cover member and the guide member while the cover member is closed.

5. The medium carrying device according to claim 4, wherein when the guide member is at the guide position, the medium regulation part is positioned between a first contact part, which is formed on the cover member and pivotal, and a second contact part, which is fixedly arranged with respect to the body of the medium carrying device, and the bias member is arranged between the first contact part and the cover member and biases the first contact part toward the medium regulation part.

6. The medium carrying device according to claim 1, wherein the guide member is arranged in a unit that is configured to be pulled out with respect to a body of an image forming apparatus, and the guide member moves toward a pull-out direction of the unit after a rotation around the rotation center starting at the guide position.

7. The medium carrying device according to claim 6, wherein the rotation of the guide member from the guide position is stopped with a third contact part that is formed on the unit, and, at the retreat position, the guide member is vertically below an outer-circumference tangent line (L2) of the second roller at the bottom, the outer-circumference tangent line being parallel to the pull-out direction of the unit.

8. The medium carrying device according to claim 6, wherein the guide member is arranged on a downstream side in the pull-out direction of the unit.

9. The medium carrying device according to claim 1, wherein the arm part is a pair of arm parts that are respectively formed at both sides of the surface of the medium regulation part, and the pair of arm parts rotates around the rotation center.

10. An image forming apparatus, comprising:

the medium carrying device according to claim 1.

11. The medium carrying device according to claim 1, wherein the guide member is arranged in a unit that is configured to be pulled out with respect to a body of an image forming apparatus, and the guide member moves toward a pull-out direction of the unit when the unit is pulled out.

12. The medium carrying device according to claim 1, wherein the first carrying part is a first roller and the second carrying part is a second roller, the guide member is arranged in a unit that is configured to be pulled out, the second roller is positioned at a downstream side from the first roller in a pull-out direction of the unit, the guide member switches its position from the guide position to the retreat position when the cover member is open, by moving in the same direction as the pull-out direction, and at the retreat position, the guide member is vertically below an outer-circumference tangent line (L2) of the second roller at the bottom, the outer-circumference tangent line being parallel to the pull-out direction of the unit.

13. The medium carrying device according to claim 1, wherein the medium regulation part includes a medium carrying surface having a long side and a short side, the long side of the medium regulation part extending in a first direction, and the arm part comprises two arm parts that are provided on both ends of the medium regulation part in the first direction and that extend from the medium regulation part in a second direction that is perpendicular to the first direction, each arm part having a projected part projecting in the second direction from the medium regulation part side to the distal end side that is opposite from the medium regulation part side.

14. The medium carrying device according to claim 1, wherein an opening is formed on the distal end side of the arm part that is opposite from a medium regulation part side of the arm part and has a circular shape, and the opening forms the rotation center.

15. The medium carrying device according to claim 1, wherein the guide member rotates between the guide position and the retreat position so that the front end part of the medium regulation part moves along an arc path, and when the guide member is at the guide position, the front end part of the medium regulation part is positioned on the arc path.

* * * * *